US006788163B2

(12) United States Patent
Benham et al.

(10) Patent No.: US 6,788,163 B2
(45) Date of Patent: Sep. 7, 2004

(54) DIGITAL NETWORK

(75) Inventors: John R. Benham, Westborough, MA (US); Rajeevan Amirtharajah, Providence, RI (US)

(73) Assignee: Intel Corporation, Santa Clara, CA (US)

( * ) Notice: Subject to any disclaimer, the term of this patent is extended or adjusted under 35 U.S.C. 154(b) by 227 days.

(21) Appl. No.: 10/041,546

(22) Filed: Jan. 7, 2002

(65) Prior Publication Data

US 2003/0128079 A1 Jul. 10, 2003

(51) Int. Cl.[7] ..... H01P 5/00
(52) U.S. Cl. ..... 333/24 R; 333/109; 333/116
(58) Field of Search ..... 333/100, 125, 333/109, 116, 110, 24 R, 111

(56) References Cited

U.S. PATENT DOCUMENTS 5,350,324 A 9/1994 Guilbert
6,236,272 B1 * 5/2001 Takei et al. ..... 330/286
6,496,886 B1 * 12/2002 Osaka et al. ..... 710/100
6,573,801 B1 6/2003 Benham et al. ..... 333/24
6,611,181 B2 * 8/2003 Marketkar et al. ..... 333/24 R

FOREIGN PATENT DOCUMENTS

EP 0 854 664 7/1998
EP 0 923 277 6/1999
JP 2000-132290 A * 5/2000 ..... G06F/3/00

* cited by examiner

*Primary Examiner*—Benny T. Lee
*Assistant Examiner*—Dean Takaoka
(74) *Attorney, Agent, or Firm*—Fish & Richardson P.C.

(57) ABSTRACT

The method of networking comprises connecting a first coupler to a first and second transmission line to couple the first and second transmission lines, connecting a second coupler to the second and a third transmission line to couple the second and third transmission lines, connecting a third coupler to the first and third transmission line to couple the first and third transmission lines, connecting a first end of the first transmission line to a first digital device, connecting a first end of the second transmission line to a second digital device, and connecting a first end of the third transmission line to a third digital device. A signal is transmitted through the first, second, or third transmission line, by one of the digital devices, and is received by at least one digital device different from the transmitting digital device.

27 Claims, 6 Drawing Sheets

DIGITAL NETWORK

BACKGROUND

This invention relates to digital networks.

Computers commonly communicate over networks. When separated by large distances, wide area networks (WANs) allow the computers to communicate. Local area networks (LANs) are used to allow computers to communicate within a small geographic area (for example, within an office building). However, networks are also used at the circuit board level to allow individual central processing units (CPU's) to share information or communicate with each other. Although such CPUs are separated by relatively small distances, the losses and reflections associated with the transmission media (e.g., conductive traces) can still be appreciable.

DESCRIPTION

As will be described in greater detail below, a network includes transmission lines, couplers that couple together the transmission lines, and digital devices connected to one end of the transmission lines. In general, a first coupler couples a first transmission line to a second transmission line, a second coupler couples the second transmission line to a third transmission line, and a third coupler couples the first transmission line to the third transmission line. A first end of the first transmission line connects to a first digital device, a first end of the second transmission line connects to a second digital device, and a first end of the third transmission line connects to a third digital device. Among other advantages, by dedicating one coupler to each two-transmission line coupling, a signal transmitted through one transmission line and received on a different transmission line couples across only one coupler. Also, by coupling the transmission lines, signal reflections are reduced at the transmission line junctions as compared to direct current (DC) connections.

Figure 1:
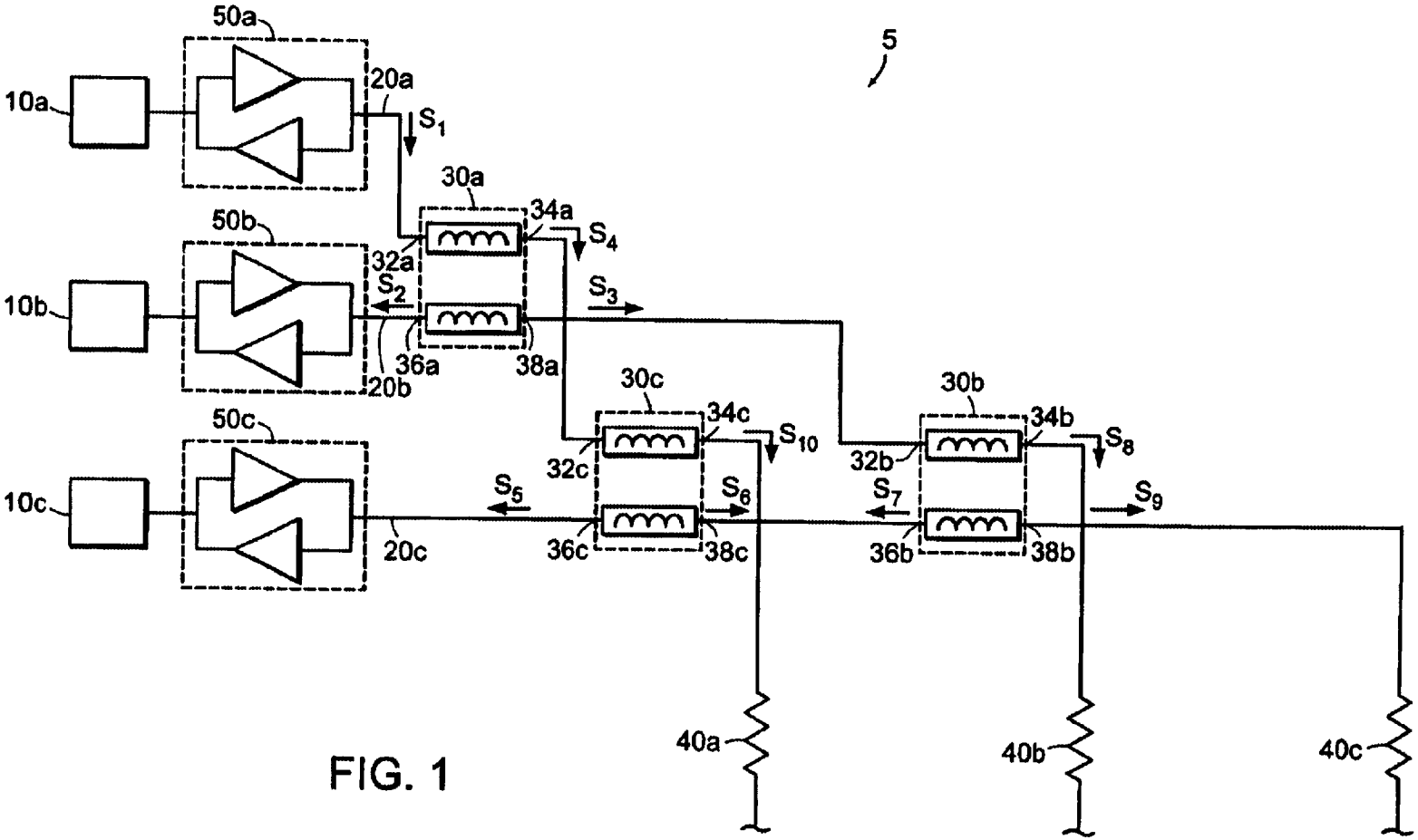
FIG. 1 is a digital network for allowing communication between three CPU's.

Referring to FIG. 1, a network 5 includes three conducting traces 20*a*, 20*b*, 20*c* each of which is associated with one of three CPUs 10*a*, 10*b*, 10*c*. In particular, each of the three conducting traces 20*a*, 20*b*, 20*c* has one end connected to a respective transceiver 50*a*, 50*b*, 50*c*, which transmits and receives signals to and from the respective connected CPU 10*a*, 10*b*, 10*c*, and an opposite end connected to a respective termination resistor 40*a*, 40*b*, 40*c*. Transceivers 50*a*, 50*b*, 50*c* match the impedance of the respective conducting trace 20*a*, 20*b*, 20*c* when receiving a signal and termination resistors 40*a*, 40*b*, 40*c* reduce internal network reflections.

Network 5 also includes couplers 30*a*, 30*b*, 30*c* that couple the conducting traces 20*a*, 20*b*, 20*c* in all unique pairings and allow signals to pass between the CPU's 10*a*, 10*b*, 10*c*. Coupling allows signals to electromagnetically transfer from one conducting trace to another. For example, coupler 30*a* couples conducting trace 20*a* to conducting trace 20*b*, coupler 30*b* couples conducting trace 20*b* to conducting trace 20*c*, and coupler 30*c* couples conducting trace 20*a* to conducting trace 20*c*. By dedicating a coupler for each conducting trace-to-conducting trace coupling, a signal transmitted from one CPU 10*a*, 10*b*, 10*c* need only couple across one respective coupler 30*a*, 30*b*, 30*c* to be received at the other CPU's. Although any transmitted signal is subjected to conductive losses of the traces as well as transmission attenuation through a coupler, the signal level is reduced by coupling across only one coupler. Thus, the attenuation associated with transmitting a signal between any of the CPUs is limited. Furthermore, because the signal is only coupled through a single coupler, this arrangement allows the network to maintain the coupling between any pair of conducting traces to be substantially the same. As mentioned above, network 5 includes three CPU's 10*a*, 10*b*, 10*c*, however network 5 can be expanded to include more CPU's. In this arrangement, the total number of couplers (E) required to couple a predetermined number of CPU's (N) in a network is determined from the following relationship:

$$E = \frac{N \times (N-1)}{2}.$$

Furthermore, the number of couplers associated with each conducting trace is one less than the number of conducting traces. For example, FIG. 1 shows three conducting traces 20*a*, 20*b*, 20*c*. Thus, two couplers must be connected to each conducting trace. Specifically, conducting trace 20*a* includes couplers 30*a* and 30*c*, conducting trace 20*b* includes couplers 30*a* and 30*b*, and conducting trace 20*c* includes couplers 30*b* and 30*c*.

Figure 2:
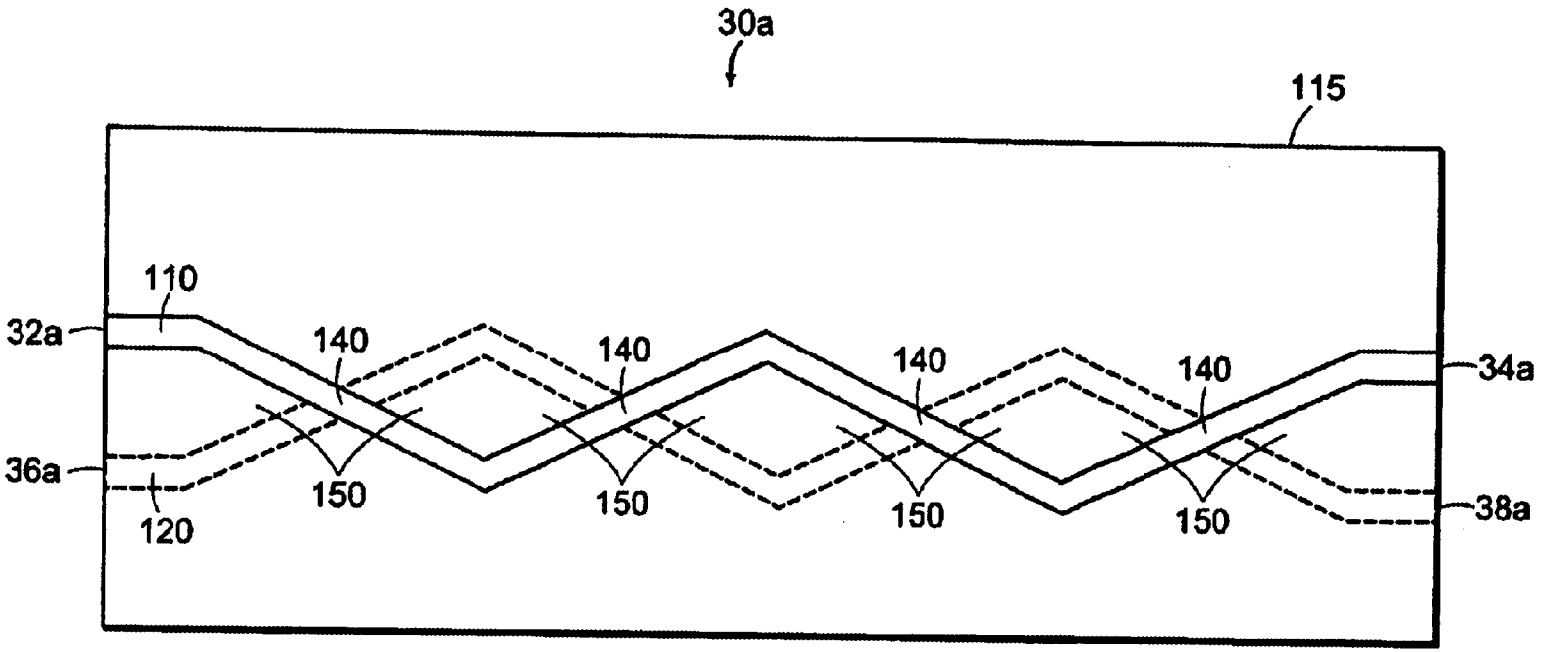
FIG. 2 is one embodiment of a coupler used in the digital network.

Referring to FIG. 2, one embodiment of coupler 30*a*, which can be used in the network 5, is shown. Coupler 30*a* is implemented as a single-ended coupler where a single conductor 110 electromagnetically couples to another single conductor 120. Conductor 110 forms one side of coupler 30*a*, and connects to conducting trace 20*a* via ports 32*a* and 34*a*, while conductor 120 forms the other side of the coupler 30*a* with associated ports 36*a* and 38*a* that connect to conducting trace 20*b*. Conductor 110 has been formed from multiple connected segments lying in a plane, where adjacent segments are arranged with an alternating angular displacement about the longitudinal axis of the conductor. Conductor 120, similarly segmented as conductor 110, is separated from conductor 110 by a dielectric 115 (e.g., polymide, FR4 glass-epoxy, or air) at some predetermined distance, with its segments lying in a plane parallel to that of conductor 110 and arranged so that the angular displacement of its segments are in the opposite sense to the corresponding segments in conductor 110, to form the zig-zag structure having their longitudinal axes aligned collinearly.

By providing a number of parallel plate capacitance regions 140 and fringe capacitance regions 150 per unit length, the geometry increases the capacitive coupling coefficient, $K_C$, available between the coupled conductors 110 and 120. A major advantage of the zig-zag coupler structure is that the value of the capacitive coupling coefficient is relatively insensitive to translation of the conductors 110, 120 in the x, y, and z dimensions. The area of parallel plate capacitance regions 140 does not vary much as the conductors 110, 120 are moved with respect to each other in their planes (x-y translation). The capacitance contributed by the fringe capacitance regions 150 similarly does not vary greatly as the separation between the conductors changes (z translation). The capacitive coupling coefficient is the ratio of the per unit length coupling capacitance to the geometric mean of the per unit length self-capacitances of the two conductors 110, 120.

In addition to the capacitive coupling coefficient, the coupler also has an inductive coupling coefficient, $K_L$, which is derived from the mutual inductance between the conductors and the self-inductance of each conductor. The mutual inductance describes the energy that is magnetically transferred from one conductor to the other. For example, a time-varying electric current flowing through conductor 110 generates a time-varying magnetic field that causes an electric current to flow through conductor 120. The self-inductance describes the energy that is stored when an electric current flows through a conductor and generates a magnetic field.

The inductive coupling coefficient, which is the ratio of the mutual inductance between the conductors to the geometric mean of the self-inductance of each individual conductor, is also proportional to the geometric mean distance between the conductors. The mutual inductance is proportional to the length of the coupler 30*a* conductors 110, 120. The capacitive and inductive parameters of a structure with a given geometry are determined by the electromagnetic material properties of the structure. The zig-zag geometry provides similar insensitivity to conductor misalignment for the inductive coupling coefficient as discussed above for the capacitive coupling coefficient.

The interaction of the capacitive and inductive coupling characteristics becomes significant, especially at higher frequencies resulting in coupler directivity. By controlling the length of the coupler to be a preferred fraction of a wavelength at a desired lower frequency, the relative magnitude of energy flow in the forward and reverse directions on the receiving conductor of the coupler 30*a* (directivity) is determined over a preferred frequency range. For example, 1 cm of length can provide approximately 3 dB directivity over a frequency range of 400 megahertz (MHz) to 3 gigahertz (GHz).

The coupling coefficient, K, quantifies the fraction of the incident signal coupled across coupler 30*a*, and comprises both the capacitive coupling coefficient ($K_C$) and inductive coupling coefficient ($K_L$). The terms "near-end" and "far-end" are used to describe whether the coupling occurs between a pair of ports nearest to, or furthest from, the port where the signal enters the coupler 30*a*. For example, a signal entering port 32*a* couples to "near-end" port 36*a* with the "near-end" coupling coefficient being proportional to the sum of $K_C$ and $K_L$:

$$K_{near\text{-}end}=A_1(K_C+K_L);$$

where $A_1$ is a constant of proportionality. However, a signal entering port 32*a* couples to "far-end" port 38*a* with the "far-end" coupling coefficient being proportional to the difference of $K_C$ and $K_L$:

$$K_{far\text{-}end}=A_2(K_C-K_L);$$

where, $A_2$ is a constant of proportionality. Thus, coupling is typically larger for "near-end" ports and the ratio $K_{near\text{-}end}/K_{far\text{-}end}$ is known as the directivity of the coupler.

Coupling coefficients have a possible range of 0 to 1, 0 representing where none of the signal is coupled and 1 representing where the entire signal is coupled. The coupling coefficient is selected by balancing four factors: (a) the need to transfer sufficient energy to the CPU's to obtain an adequate signal-to-noise ratio and correspondingly low bit error rates, (b) the need to share the available source energy across multiple conducting traces rather than allowing the first coupled conducting trace to extract a major portion of the signal energy, (c) the need to control inter-symbol interference arising from reflections at the interface of the couplers and the conducting traces, and (d) selecting large coupling coefficient values requires correspondingly low impedance conducting traces which can increase power dissipation. The coupling process has the effect of reducing the impedance of the conductors 110, 120 proportional to the increase of the coupling coefficient. Minimal reflections occur when the impedance seen at the coupling ports 32*a*, 34*a*, 36*a*, 38*a* are matched (equal) to the impedance of the connected conducting traces 20*a*, 20*b*. By increasing the width, and possibly the thickness, of the conducting traces 20*a*, 20*b*, the impedance can be matched. However, selecting a large coupling coefficient, requiring large conducting trace dimensions, can limit the number of conducting traces within a particular area. Generally, when networking CPU's with conducting traces on a circuit board, useful coupling coefficients have been found to range from 0.27 to 0.43. Although the signal level is reduced by the coupling, the receiving CPU can still detect these signals with adequately low error rates.

Figure 3:
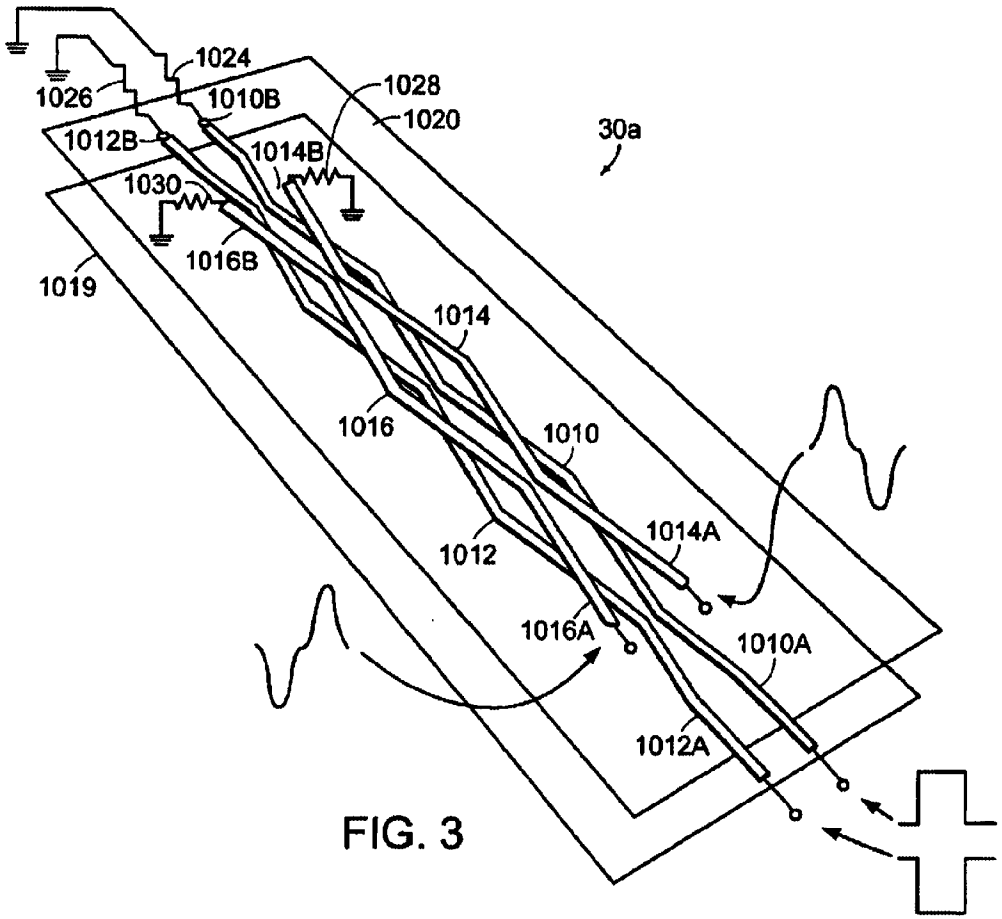
FIG. 3 is one embodiment of a differential coupler used in the digital network.

Referring to FIG. 3, one embodiment of an alternative geometry for the coupler 30*a* is shown. Coupler 30*a* includes a differential pair of conductors 1010 and 1012. Conductor 1010 is coupled to a second conductor 1014, while conductor 1012 is coupled to a second conductor 1016. A first reference plane 1019 is placed below the first set of conductors 1010, 1012, to act as a return conductor for these transmission lines. A second reference plane 1020 is placed above the second set of conductors 1014 and 1016 to act as a return conductor for the transmission lines 1014 and 1016. Ends 1010B and 1012B of the first conductors 1010 and 1012 are terminated with matched termination resistors 1024 and 1026. Ends 1014B and 1016B of the second set of conductors are also terminated with matched resistors 1028 and 1030.

A differential digital signal is applied to ends 1010A and 1012A of the first conductors, and a resulting differential coupled signal is then observed at the set of conductor ends 1014A and 1016A. Conversely, a differential digital signal is applied to ends 1014A and 1016A of the second conductors, and a resulting differential coupled signal is then observed at the set of conductor ends 1010A and 1012A. Thus, the first and second set of conductors are reciprocally coupled by their electromagnetic fields. Alignment insensitivity of the coupler aids differential signaling by reducing mismatches between the coupler formed by conductors 1010 and 1014 and the coupler formed by conductors 1012 and 1016.

The differential coupler 30*a* reduces the effects of radiation. The use of differential signaling, with anti-phased currents flowing in the differential conductor pair, causes the radiation to fall rapidly to zero as the distance from the differential pair is increased. The differential signaling version of the coupler 30*a* therefore offers lower far-field electromagnetic radiation levels than the single ended implementation shown in FIG. 2.

The effects of far-field radiation may be further reduced by selecting an even number of conductor segments (e.g., eight segments) for coupler 30*a*. Thus offering potentially lower far-field electromagnetic radiation levels compared to an implementation using an odd number of conductor segments.

Coupler 30*a* has a differential pair of conductors that alternately approach each other and then turn away. Because the conductors 1014 and 1016 of the second transmission structure have segments with equal and opposite angular displacements to conductors 1010 and 1012, respectively, this structure reduces the effects of capacitive cross-talk between conductors 1010 and 1016 and conductors 1012 and 1014 due to misalignment of the conductors.

Figure 4:
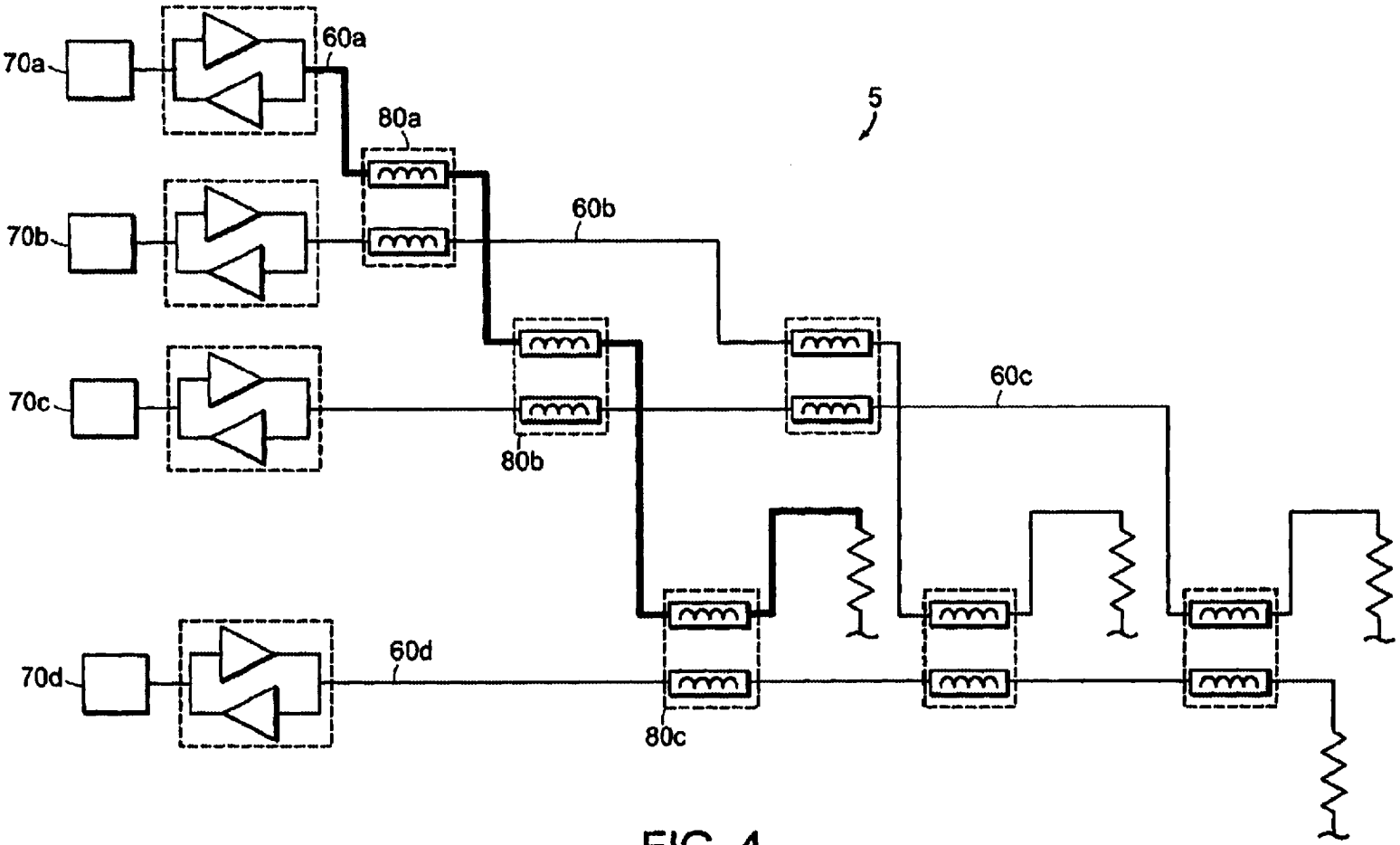
FIG. 4 is an alternative embodiment of the invention for allowing communication between four CPU's.

Referring to FIG. 4, the digital network 5 is extendable to allow communication between numerous CPU's, for example with four CPUs 70*a*–70*d* as shown here. In this example, four conducting traces 60*a*, 60*b*, 60*c*, 60*d* with three couplers per conducting trace (one less the number of conducting traces) are used to couple the CPUs. For example, conducting trace 60*a* (highlighted) connects to the three couplers 80*a*, 80*b*, and 80*c*.

Returning to FIG. 1, couplers 30*a*, 30*b*, 30*c* are four port devices and include a first port 32*a*, 32*b*, 32*c*, a second port 34*a*, 34*b*, 34*c*, a third port 36*a*, 36*b*, 36*c*, and a fourth port 38*a*, 38*b*, 38*c*, respectively. Energy transfer between first ports and third ports as well as between first ports and fourth ports is bilaterally symmetric. However, as stated above, when a signal passes from a conducting trace into a port, a portion of the signal is "coupled" to the ports associated with the other connected conducting trace. For example, again using coupler 30*a*, when a signal from conducting trace 20*a* enters port 32*a*, a portion of the signal is coupled to the third port 36*a* and fourth port 38*a*. Due to the directivity of the coupler, the coupled signal at the third port 36*a* is typically larger in amplitude than the coupled signal at the fourth port 38*a*. This bilateral symmetric coupling occurs in the opposite direction with similar results. For example, a signal propagating on trace 20*b* enters the third port 36*a* and a portion of the signal is coupled to the first and second ports 32*a*, 34*a*. In this case, the directivity ensures that the "near-end" coupled signal, from the third port 36*a* to the first port 32*a*, is typically larger in amplitude than the "far-end" coupled signal, coupled from the third port 36*a* to the second port 34*a*.

As a signal propagates through one of the conducting traces 20*a*, 20*b*, 20*c*, the signal can couple across multiple couplers and propagate onto multiple conducting traces, thereby being broadcast to multiple CPU's 10*a*, 10*b*, 10*c*. For example, in transmitting a signal from CPU 10*a* to CPU 10*c*, CPU 10*a* transmits a signal through transceiver 50*a* and onto conducting trace 20*a*. The signal passes into the first port 32*a*, of coupler 30*a*, and is coupled onto conducting trace 20*b* via third and fourth ports 36*a*, 38*a*. The signal also propagates out the second port 34*a*, onto conducting trace 20*a*, and into coupler 30*c*, which couples the signal onto conducting trace 20*c*. Since the signal is present on both conducting traces 20*b* and 20*c*, both CPU 10*b* and CPU 10*c* can receive the signal after it passes though the respective transceivers 50*b* and 50*c*. Due to the bilateral behavior of the couplers, the network can therefore be used to broadcast information from CPU 10*a* to CPU 10*b* and CPU 10*c*, or from CPU 10*b* to CPU 10*a* and CPU 10*c*, or from CPU 10*c* to CPU 10*a* and CPU 10*b*. This property is useful, for example, if one CPU is required to transfer data to a second CPU while a third CPU observes and checks the transferred data, or in another example, where one CPU provides replicated copies of data to other CPU's. If required that one of the CPU's should not receive the data, that particular CPU can be placed in a non-receptive state.

Network 5 has the property that data can be transferred directly between any two CPU's via a single coupler path. However as a signal propagates throughout the network 5, it can be present on each conducting trace 20*a*, 20*b*, 20*c* by coupling across two or more of the couplers 30*a*, 30*b*, 30*c*. The energy coupled across multiple couplers presents a concern for achieving reliable and high data rate communication over the network 5. If this energy is too large, relative to the energy coupled across one coupler, unwanted signals may be detected at the receiving CPU's or it may interfere with the desired signals causing bit errors in the received data stream. However, by coupling across two couplers, the entering signal level is reduced by the coupling coefficients of both couplers. Coupling across two of the couplers is equivalent to coupling across one coupler with a coupling coefficient equal to the product of the two individual coupling coefficients. Thus, a signal coupling across two couplers, each with a coupling coefficient range of 0.27 to 0.43, will experience an overall coupling coefficient range of K*K, or 0.073 to 0.185. So, for a signal coupling across two couplers, only 7.3% to 18.5% of the original signal amplitude is coupled. Further, the network 5 has the property that coupling across two or more couplers requires at least one "far-end" coupling. Thus, multiple coupling further reduces the signal level with the directivity of the coupler. For example, couplers with 6 dB directivity will further reduce a signal, transmitted across multiple couplers, to less than 3.6% to 9.2% of the original signal. Signal levels in this range are below the detectable range of the CPU's 10*a*, 10*b*, 10*c*, thus signals passing across two or more couplers are rendered undetectable. So, by providing a dedicated coupler, between each unique conducting trace pair, the detectability and interference of undesirable signals is reduced due to coupling across two couplers and the directivity of at least one coupler.

To better understand the operation and advantages of a network 5 configured above, an example of transmitting a signal between CPU's is demonstrated by transmitting a signal from CPU 10*a* to CPU 10*b* and CPU 10*c*. A digital signal, $S_1$, is transmitted from CPU 10*a* to conducting trace 20*a*, via transceiver 50*a*. Signal $S_1$ enters the first port 32*a*, of the coupler 30*a*, and a portion of signal $S_1$ is coupled to the third and fourth ports 36*a*, 38*a*. Coupled signal portion, $S_2$, exits the third port 36*a* while coupled signal portion, $S_3$, exits the fourth port 38*a*. In this case, the directivity of coupler 30*a* ensures that the "near-end" coupled signal, $S_2$, at the third port 36*a* has a larger magnitude than the "far-end" coupled signal, $S_3$, at the fourth port 38*a*. Signal $S_2$ passes through transceiver 50*b*, via conducting trace 20*b* and is received by CPU 10*b*. Signal $S_4$ exits the second port 34*a*, of coupler 30*a*, and has a magnitude close to signal $S_1$'s magnitude due to the relatively small amount of signal energy removed by coupler 30*a*. Signal $S_4$ enter the first port 32*c*, of coupler 30*c*, and couples across to the third port 36*c* and the fourth port 38*c*. Due to the directivity of the coupler 30*c*, the signal $S_5$, at the third port 36*c*, is larger in magnitude than the signal $S_6$ at the fourth port 38*c*. Signal $S_5$ propagates through conducting trace 20*c*, and is transmitted to CPU 10*c*, via transceiver 50*c*. Signal $S_3$ exits the fourth port 38*a* and passes through conducting trace 20*b* into the first port 32*b* of coupler 30*b*. Signal $S_3$ produces a coupled signal $S_7$ at the third port 36*b* that propagates onto trace 20*c*. However, signal $S_7$ is very small in magnitude because it has been reduced by the product of coupling coefficients of couplers 30*a* and 30*b* and also by the directivity of coupler 30*a*. The signals $S_8$ and $S_9$, exiting the second port 34*b* and the fourth port 38*b*, are absorbed by the resistors 40*b* and 40*c*. Similarly, signal $S_6$ propagates to the third port 36*b*, of coupler 30*b*, and couples to the first port 32*b* producing a signal $S_{11}$ that exits port 32*b*. However, signal $S_{11}$ has been reduced to an undetectable magnitude by the product of the coupling coefficients of couplers 30*c* and 30*b* and also by the directivity of coupler 30*c*. The signal $S_{10}$, the remaining portion of signal $S_4$, exits the second port 34*c* of coupler 30*c* and is absorbed in resistor 40*a*.

Figure 5:
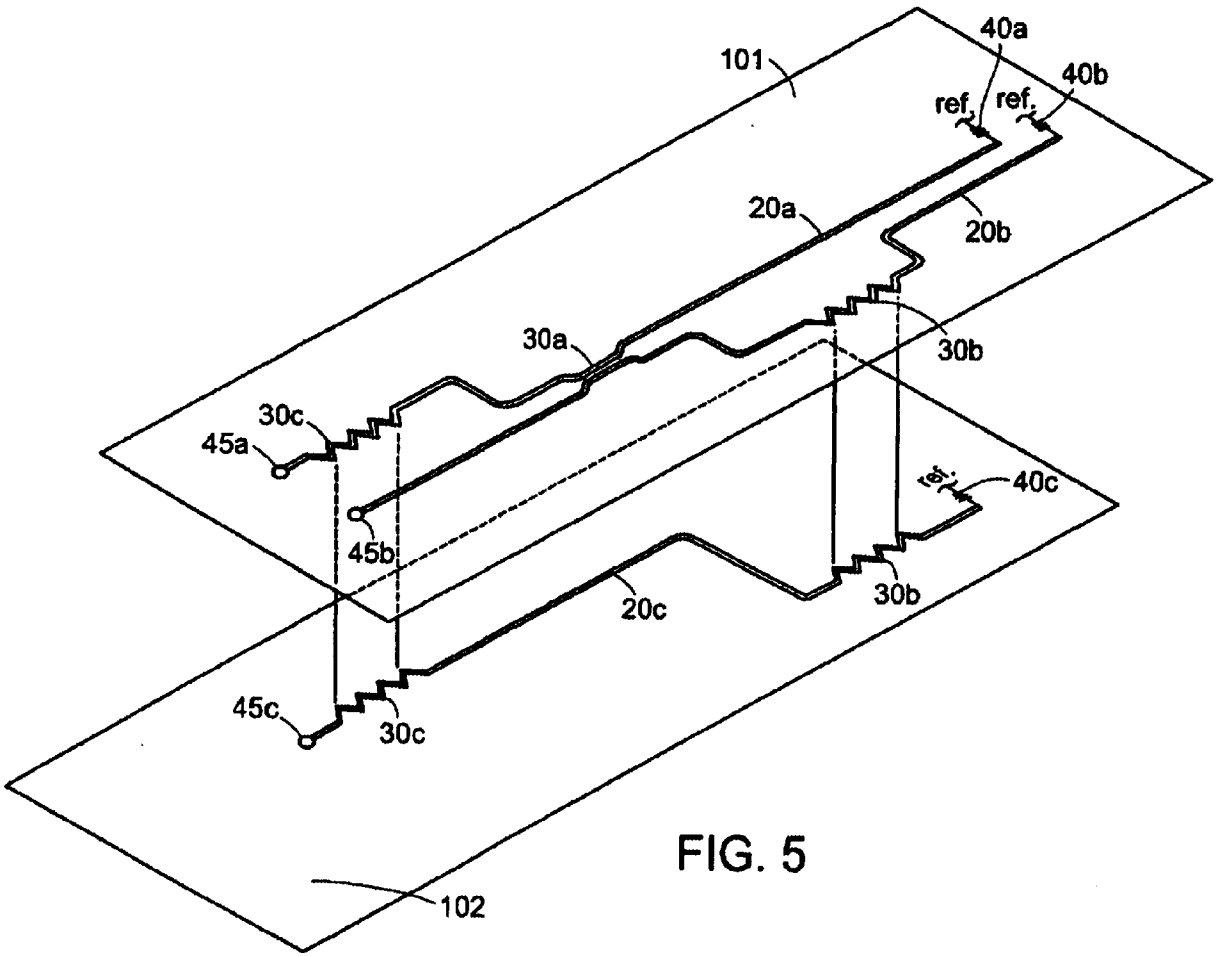
FIG. 5 is an alternative embodiment of the invention for allowing communication between printed circuit board layers.

Referring to FIG. 5, a physical layout of network 5 is shown. In particular, this layout allows communication between a pair of adjacent printed circuit board layers 101, 102. Adjacent layers 101, 102 of a printed circuit board 100 contain conducting traces 20*a*, 20*b*, 20*c*. Layer 101, is positioned above the layer 102, and conducting traces 20*a* and 20*b* extend across layer 101 while conducting trace 20*c* extends across layer 102. As in the examples above, couplers 30*a*, 30*b*, 30*c* provide a dedicated connection between each unique pair of conducting trace 20*a*, 20*b*, 20*c*, and thus additional interconnections between the layers 101, 102 are thereby avoided. Coupler 30*a* couples signals across conducting traces 20*a* and 20*b*, while coupler 30*b* couples signals across conducting traces 20*b* and 20*c*, and coupler 30*c* couples signals across conducting traces 20*a* and 20*c*. The geometry of coupler 30*a* is designed for coupling across conducting traces 20*a* and 20*b* on the same layer 101 and differs from the geometry of couplers 30*b* and 30*c* which couples across two layers 101, 102. If couplers 30*b* and 30*c* are selected to be insensitive to misalignment, layers 101 and 102 can be manufactured as individual assemblies that can be mated together. Resistors 40*a*, 40*b*, 40*c* terminate the conducting lines 20*a*, 20*b*, 20*c*, and external circuitry is accessible with terminals 45*a*, 45*b*, 45*c*.

Figure 6:
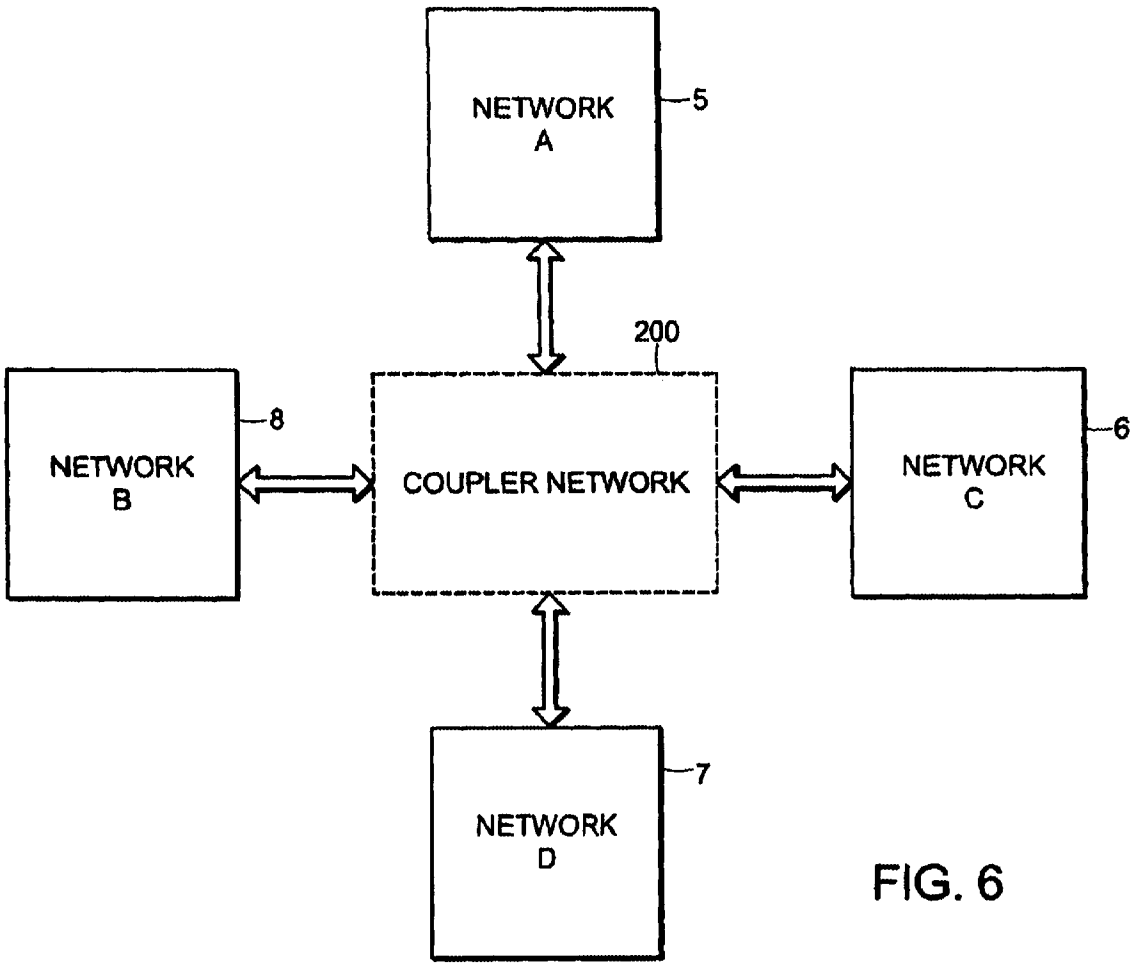
FIG. 6 is an alternative embodiment of the invention for allowing communication between networks.

Referring to FIG. 6, a coupler network 200 transmits signals between four digital networks 5, 6, 7, 8. The coupler network 200 includes couplers (not shown), similar to the couplers mentioned above, except each coupler provides a dedicated connection between each unique pair of networks 5, 6, 7, 8. The number of couplers (E), in the coupler network 200, is governed by the same relationship as above, however the number of CPU's (N) is replaced with the number of networks (M):

$$E = \frac{M \times (M-1)}{2}.$$

Also, as was the case with the arrangement of FIG. 1, a signal transmitted into the coupler network 200, from one of the networks 5, 6, 7, 8 via respective connected bus 205, 206, 207, 208, couples across only one coupler in order to be received by another network. For example, network 5 transmits a signal into coupler network 200 via bus 205. The signal couples across one coupler (not shown), within the coupler network 200, and is transferred to network 6. Thus, one network can broadcast a signal to the other three networks and the signal will only couple across one coupler, within the coupler network 200, to each of the other networks.

In the example discussed above in conjunction with FIG. 1, CPU's 10*a*, 10*b*, and 10*c* transmit and receive digital signals, however other digital devices can be used to transmit and receive the digital signals. For example, memory chips, memory controllers, input/output controllers, graphics processors, network processors, programmable logic devices, network interface devices, flip-flops, combinational logic devices or other similar digital devices can be used to transmit and receive digital signals. Some CPU's may also contain transceivers within their internal circuitry. So, in another example, transceivers 50*a*, 50*b*, 50*c* would be contained within the respective CPU's 10*a*, 10*b*, 10*c*. Various devices can also be used to condition signals that are transmitted and received by the CPU's. Along with transceivers, translating buffers or similar signal conditioning devices can be connected to the CPU's to condition the signals.

Various types of transmission lines can be used to connect the CPU's 10*a*, 10*b*, 10*c* to the couplers 30*a*, 30*b*, 30*c* to form the network 5. As mentioned above, conducting traces are often used on circuit boards to connect CPU's. These traces are also used on multiple-layer circuit cards. However, other transmission lines such as etched conductors, flex circuits, wire-wrapped wires, cables, or similar conducting devices can be used to connect the CPU's 10*a*, 10*b*, 10*c* to the couplers 30*a*, 30*b*, 30*c*. Multiple conducting traces (e.g., buses) can also be connected to each CPU 10*a*, 10*b*, 10*c*. By connecting the multiple conducting traces in the same sequence, to each CPU 10*a*, 10*b*, 10*c*, transmitted signals will experience equivalent propagation delays regardless of which CPU transmitted the signal. Similarly, it is advantageous to have equivalent propagation delays through the couplers connected to the multiple conducting traces.

As mentioned above, also in conjunction with FIG. 1, couplers 30*a*, 30*b*, 30*c* couple a portion of the signals between conducting traces 20*a*, 20*b*, 20*c*. However, other couplers such as capacitive couplers, inductive couplers, or other similar devices can be used to couple the signals between the conducting traces. Differential couplers (e.g., 8-port differential couplers) can also be used to couple differential signals to the CPU's. Each coupler structure may be physically separated, for example, into two component halves. The couplers can also be configured from stripline, microstrip, slotline, finline, coplanar waveguide structures, or similar waveguide structures.

The networks described above can support various signaling methodologies to achieve high data rate communication. Some examples include binary digital signaling, multiple-voltage level signaling, edge- or pulse-based modulated signaling schemes, narrowband modulated carrier schemes such as QAM, QPSK, FSK, or similar modulation techniques. For optimal communication, in terms of data rate and reliability, the signaling approach is tailored to the characteristics of the particular network.

Various types of impedances can terminate the conducting traces 20*a*, 20*b*, 20*c* and reduce the internal reflections of the signals within the network 5. As mentioned above, resistors 40*a*, 40*b*, 40*c* can terminate the conducting traces 20*a*, 20*b*, 30*c*, however any type of impedance can terminate the traces. For example, capacitors, inductors, diodes, or transistors can provide impedance to terminate the conducting traces. Also the capacitors, inductors, diodes, and transistors can also be used in combination with resistors to provide the terminations.

A number of examples of the invention have been described. Nevertheless, it will be understood that various modifications may be made without departing from the spirit and scope of the invention. Accordingly, other examples are within the scope of the following claims.

What is claimed is:

1. A network comprising:

a first transmission line and a second transmission line;

a first coupler that couples the first transmission line, the first coupler includes a first conductor and a second conductor, the second conductor includes segments each having an angular displacement relative to an axis parallel to the second conductor;

a third transmission line;

a second coupler that couples the second transmission line to the third transmission line;

a third coupler that couples the first transmission line to the third transmission line;

a first end of the first transmission line connects to a first digital device;

a first end of the second transmission line connects to a second digital device; and a first end of the third transmission line connects to a third digital device.

2. The network of claim 1 wherein the first, second and third transmission lines are conducting traces.

3. The network of claim 1 wherein the digital devices are central processing units.

4. The network of claim 1 wherein the couplers are separable.

5. The network of claim 1 wherein a second end of the first transmission line connects to a termination, a second end of the second transmission line connects to a termination, and a second end of the third transmission line connects to a termination.

6. The network of claim 5 wherein the termination is a resistor.

7. The method of networking, comprising:

connecting a first coupler to a first and a second transmission line, the first coupler couples the first transmission line to the second transmission line, the first coupler includes a first conductor and a second conductor, the second conductor includes segments each having an angular displacement relative to an axis parallel to the second conductor;

connecting a second coupler to the second and a third transmission line, the second coupler couples the second transmission line to the third transmission line;

connecting a third coupler to the first and the third transmission line, the third coupler couples the first transmission line to the third transmission line;

connecting a first digital device to a first end of the first transmission line;

connecting a second digital device to a first end of the second transmission line;

connecting a third digital device to a first end of the third transmission line;

transmitting a signal through one of the first, second, and third transmission lines; and receiving the signal on at least one of the first, second, and third transmission lines, different from the transmission line transmitting the signal.

8. The method of claim 7, further comprising:

connecting the transmission lines, wherein the transmission lines are conducting traces.

9. The method of claim 7, further comprising:

connecting the digital devices, wherein the digital devices are central processing units.

10. The method of claim 7, wherein the signal is a single-ended electrical signal.

11. The method of claim 7, wherein the signal is a differential electrical signal.

12. The method of claim 7, wherein the couplers are separable.

13. The method of claim 7, further comprising:

connecting a second end of the first transmission line to a termination;

connecting a second end of the second transmission line to a termination; and connecting a second end of the third transmission line to a termination.

14. The method of claim 13, further comprising:

connecting the termination, wherein the termination is a resistor.

15. A network comprising:

a first transmission line and a second transmission line;

a first coupler that couples the first transmission line to the second transmission line, the first coupler includes a first conductor and a second conductor, the second conductor includes segments each having an angular displacement relative to an axis parallel to the second conductor;

a third transmission line;

a second coupler that couples the second transmission line to the third transmission line;

a third coupler that couples the first transmission line to the third transmission line;

a first end of the first transmission line connects to a first terminal adapted to connect to a first digital device;

a first end of the second transmission line connects to a second terminal adapted to connect to a second digital device; and a first end of the third transmission line connects to a third terminal adapted to connect to a third digital device.

16. The network of claim 15 wherein the first, second and third transmission lines are conducting traces.

17. The network of claim 15 wherein a second end of the first transmission line connects to a termination, a second end of the second transmission line connects to a termination, and a second end of the third transmission line connects to a termination.

18. The first coupler of claim 1 wherein the angular displacement is selected such that when positioning the second conductor proximate to the first conductor, substantially constant coupling is maintained over a range of relative positions of the first and second conductors.

19. The first coupler of claim 1 wherein the first conductor includes segments each having an angular displacement relative to an axis parallel to the first conductor.

20. The first coupler of claim 19 wherein the angular displacement of the segments of the first conductor has an opposite sense to the angular displacement of the segments of the second conductor.

21. The first coupler of claim 1 wherein the segments of the second conductor form a zig-zag geometry.

22. The first coupler of claim 19 wherein the segments of the second conductor form a zig-zag geometry and the segments of the first conductor form a zig-zag geometry having an opposite sense.

23. The first coupler of claim 22 wherein a dielectric material separates the first conductor and the second conductor.

24. The first coupler of claim 7 wherein the angular displacement is selected such that when positioning the second conductor proximate to the first conductor, substantially constant coupling is maintained over a range of relative positions of the first and second conductors.

25. The first coupler of claim 7 wherein the first conductor includes segments each having an angular displacement relative to an axis parallel to the first conductor.

26. The first coupler of claim 15 wherein the angular displacement is selected such that when positioning the second conductor proximate to the first conductor, substantially constant coupling is maintained over a range of relative positions of the first and second conductors.

27. The first coupler of claim 15 wherein the first conductor includes segments each having an angular displacement relative to an axis parallel to the first conductor.

* * * * *